US005772032A

United States Patent [19]

Goldman

[11] Patent Number: 5,772,032

[45] Date of Patent: Jun. 30, 1998

[54] CORRUGATED BOX WITH EXTERIORALLY SUPPORTED PRODUCT-STABILIZING FLAPS

[75] Inventor: Joseph Goldman, Plymouth, Minn.

[73] Assignee: Federal Industries Corporation, Plymouth, Minn.

[21] Appl. No.: 965,831

[22] Filed: Nov. 7, 1997

[51] Int. Cl.[6] ..... B65D 5/06

[52] U.S. Cl. ..... 206/485; 206/588; 206/524.5

[58] Field of Search ..... 229/125.15, 125.04; 206/588, 589, 590, 524.1, 524.5, 485, 486

[56] References Cited

U.S. PATENT DOCUMENTS

| | | | |
|---|---|---|---|
| 2,682,949 | 7/1954 | Whitehead . | |
| 3,062,367 | 11/1962 | Holy . | |
| 3,167,235 | 1/1965 | Hailey et al. . | |
| 4,219,149 | 8/1980 | Stask | 229/125.15 X |
| 4,324,357 | 4/1982 | Murkowski | 206/485 X |
| 4,394,905 | 7/1983 | Hackenberg . | |
| 4,821,847 | 4/1989 | Uhlig . | |
| 5,520,283 | 5/1996 | Sutherland . | |
| 5,577,614 | 11/1996 | Palmeroni, Jr. et al. | 206/588 X |

OTHER PUBLICATIONS

*Commercial Product*: Corrugated boxes by various manufacturers with separate inserts in commecial use prior to 1997.

*Primary Examiner*—Jacob K. Ackun
*Attorney, Agent, or Firm*—James V. Harmon

[57] ABSTRACT

A single-piece corrugated box suited for shipping one or more articles, e.g. hazardous articles such as cans of paint, varnish, solvent or other liquid hydrocarbon includes four upright side wall panels that are connected by vertical fold lines and upper and lower pairs of abutting, full-overlap article-stabilizing flaps that are provided with punched openings therein positioned in vertical alignment with each other so that one pair of stabilizing flaps surrounds and interlocks over the upper end of the article and the other pair of stabilizing flaps surrounds and interlocks over the lower end of the article. Each pair of stabilizing flaps is supported exteriorally by a pair of laterally opposed end flaps which are folded centrally so as to enclose and abut the ends of the article as well as the underlying stabilizing flaps. The stabilizing flaps are hinged to the side walls of the box by horizontal fold lines. These fold lines form opposed anchoring points for the stabilizing flaps which cooperate with the interlocking of the stabilizing flaps over the article to strengthen and rigidify the box to enhance protection of the article that is packaged therein. The stabilizing flaps both extend horizontally in a straight line toward the article from the side wall to serve as a shock- and pressure-resisting brace between the article being shipped and the side wall of the box.

7 Claims, 6 Drawing Sheets

CORRUGATED BOX WITH EXTERIORALLY SUPPORTED PRODUCT-STABILIZING FLAPS

FIELD OF THE INVENTION

This invention relates to packaging and more particularly to folding boxes with integral stabilizing members.

BACKGROUND OF THE INVENTION

In recent years, suppliers and shippers have become increasingly concerned about safety in shipping hazardous materials such as paint, solvents, petroleum distillates, varnish, and other flammable liquids contained in metal cans, for convenience hereinafter referred to simply as "hazardous material." While these products have been shipped in boxes, the cost, convenience, and ease in filling and assembling the package have not been entirely satisfactory. Moreover, boxes that have been used in the past have sometimes failed to provide the best possible protection for the contents of the package. One previous package that was used in the past required several corrugated inserts consisting of separate pieces, each of which had to be handled separately and placed manually between the can of hazardous material and the walls of the corrugated box. Filling the box is time-consuming and requires four separate steps: the placement of the bottom spacers, the placement of the top spacers, the closing of the bottom of the box, and the closing of the top of the box. Furthermore, because the inserts consisted of separate pieces unconnected to other parts of the package, they had to be oriented and positioned entirely by hand.

In view of these and other deficiencies of the prior art, it is a primary object of the present invention to provide an improved shipping box which furnishes enhanced protection for hazardous materials at a cost equal to or below the cost of current packaging.

It is another object of the present invention to provide excellent protection for hazardous materials while achieving cost economies through a saving of paper.

A further object is to provide an improved protection for hazardous materials through the provision of more positive support by securely holding the contents in spaced relationship from the side walls of the box.

Another object of the invention is to provide a corrugated box for hazardous materials wherein the closing of the package is facilitated by the provision of product-retaining members that are self-orienting and self-positioning.

Yet another object of the invention is to provide an improved package for hazardous material that is formed from a single sheet of corrugated board and can meet or exceed applicable performance test requirements for both land and air shipment of hazardous materials.

These and other more detailed and specific objects of the present invention will be better understood by reference to the following figures and detailed description which illustrate by way of example but a few of the various forms of the invention within the scope of the appended claims.

SUMMARY OF THE INVENTION

The invention provides a single-piece corrugated box that is suited for shipping one or more articles, and is particularly well suited for shipping hazardous articles such as cans of paint, varnish, solvent or other liquid hydrocarbons. The box includes four upright side wall panels that are connected by vertical fold lines. Upper and lower pairs of abutting full overlap article-stabilizing flaps are provided with punched openings therein that are positioned in vertical alignment with each other and interlocked over the article being shipped so that one pair of stabilizing flaps surrounds the upper end of the article and the other paid or stabilizing flaps surrounds the lower end of the article. Each pair of stabilizing flaps is supported exteriorally by end flaps, preferably consisting of a pair of laterally opposed half-flaps, i.e., end flaps which are folded centrally so as to meet along a center line for enclosing and abutting the ends of the article being shipped and the underlying stabilizing flaps. The stabilizing flaps, which are themselves devoid of fold lines, are hinged to the side walls of the box by horizontal fold lines. These fold lines form opposed anchoring points for the stabilizing flaps which cooperate with the interlocking of the stabilizing flaps over the article being shipped to strengthen and rigidify the box, thereby protecting the article that is packaged therein. The stabilizing flaps both extend horizontally in a straight line toward the article from the fold line to provide a lateral shock- and pressure-resisting brace between the article being shipped and the side wall of the box. Contact between the stabilizing flaps and the overlapped end flaps provide additional support for the stabilizing flaps exteriorally to further strengthen and immobilize the stabilizing flaps at each end of the package.

THE FIGURES

DETAILED DESCRIPTION OF THE INVENTION

Figure 4:
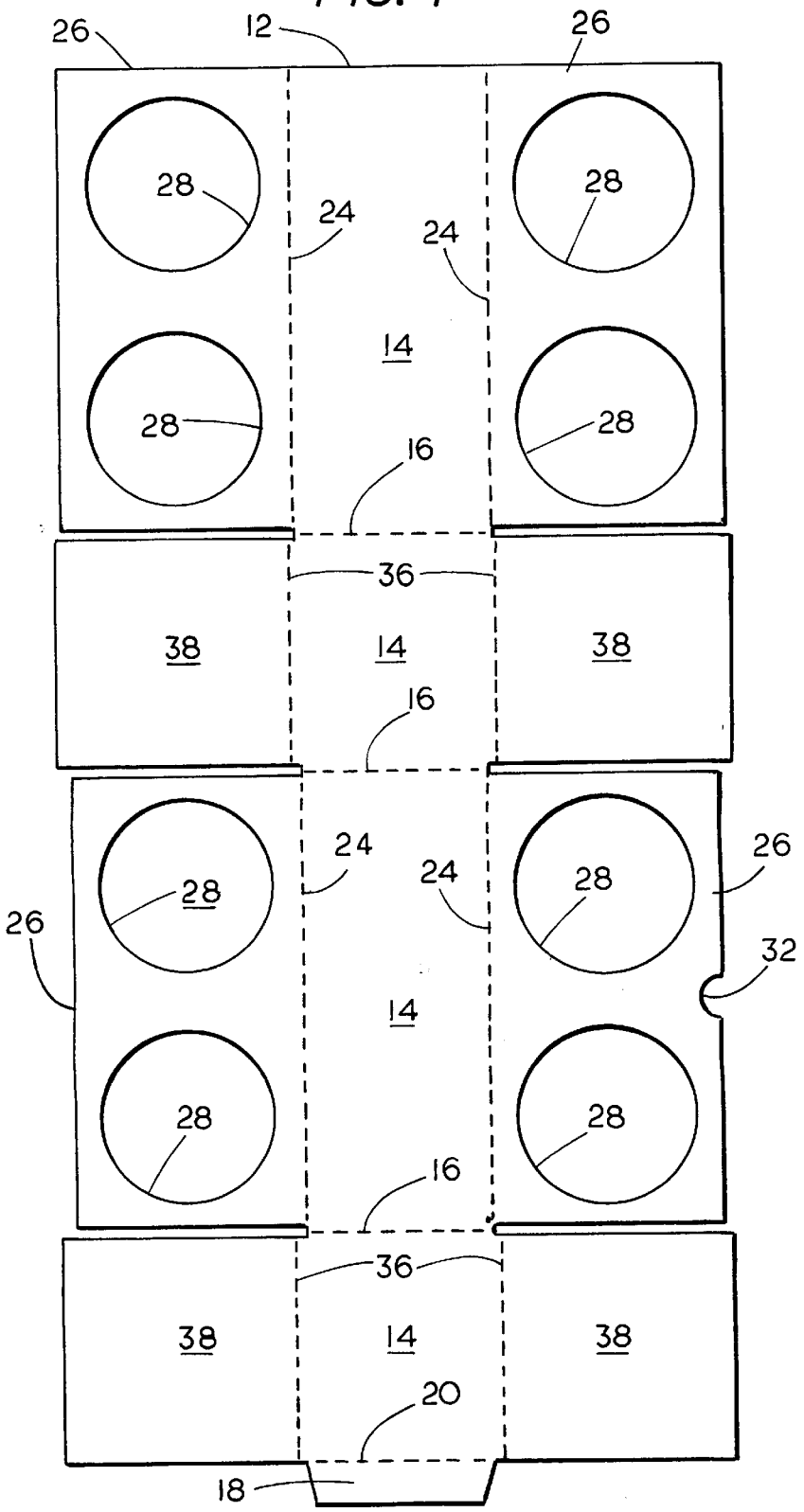
FIG. 4 is a box blank in accordance with the invention for holding two cans.
Figure 5:
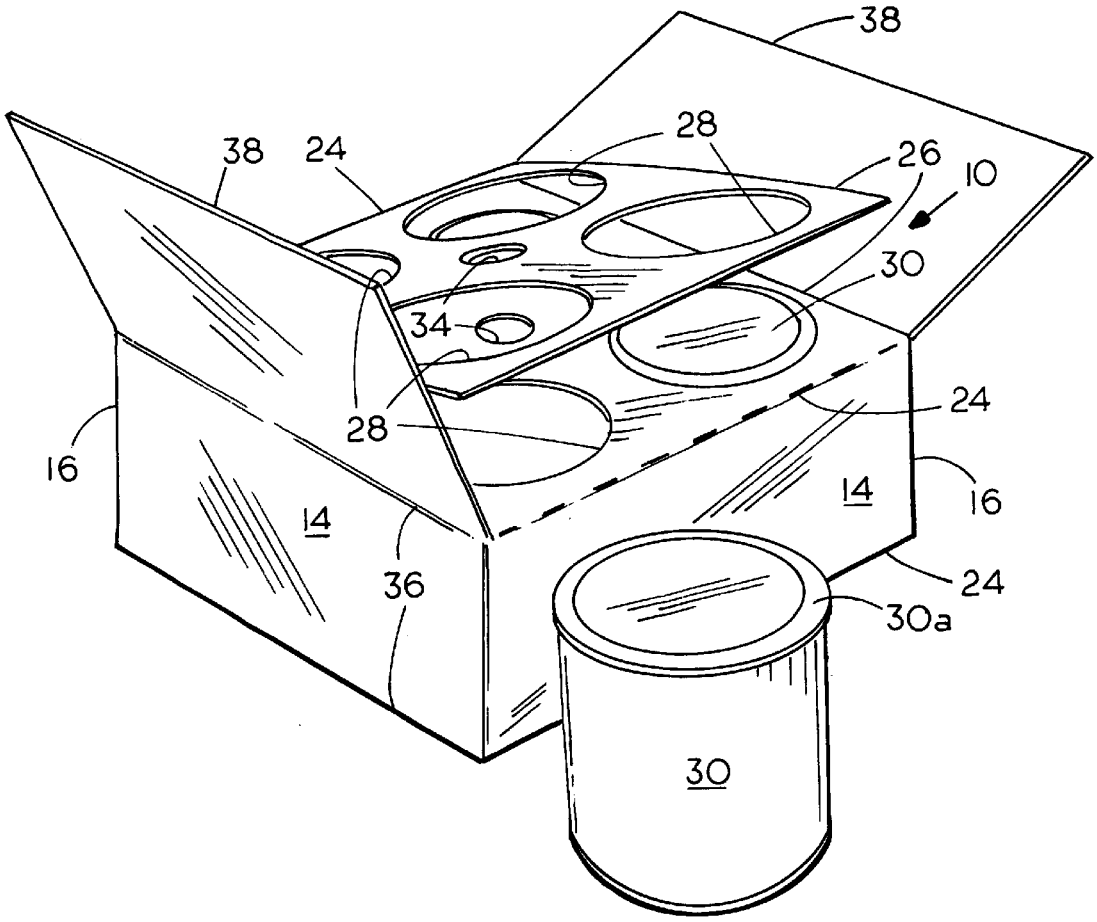
FIG. 5 is a perspective view of a corrugated box in accordance with the invention for holding four cans of equal size.
Figure 6:
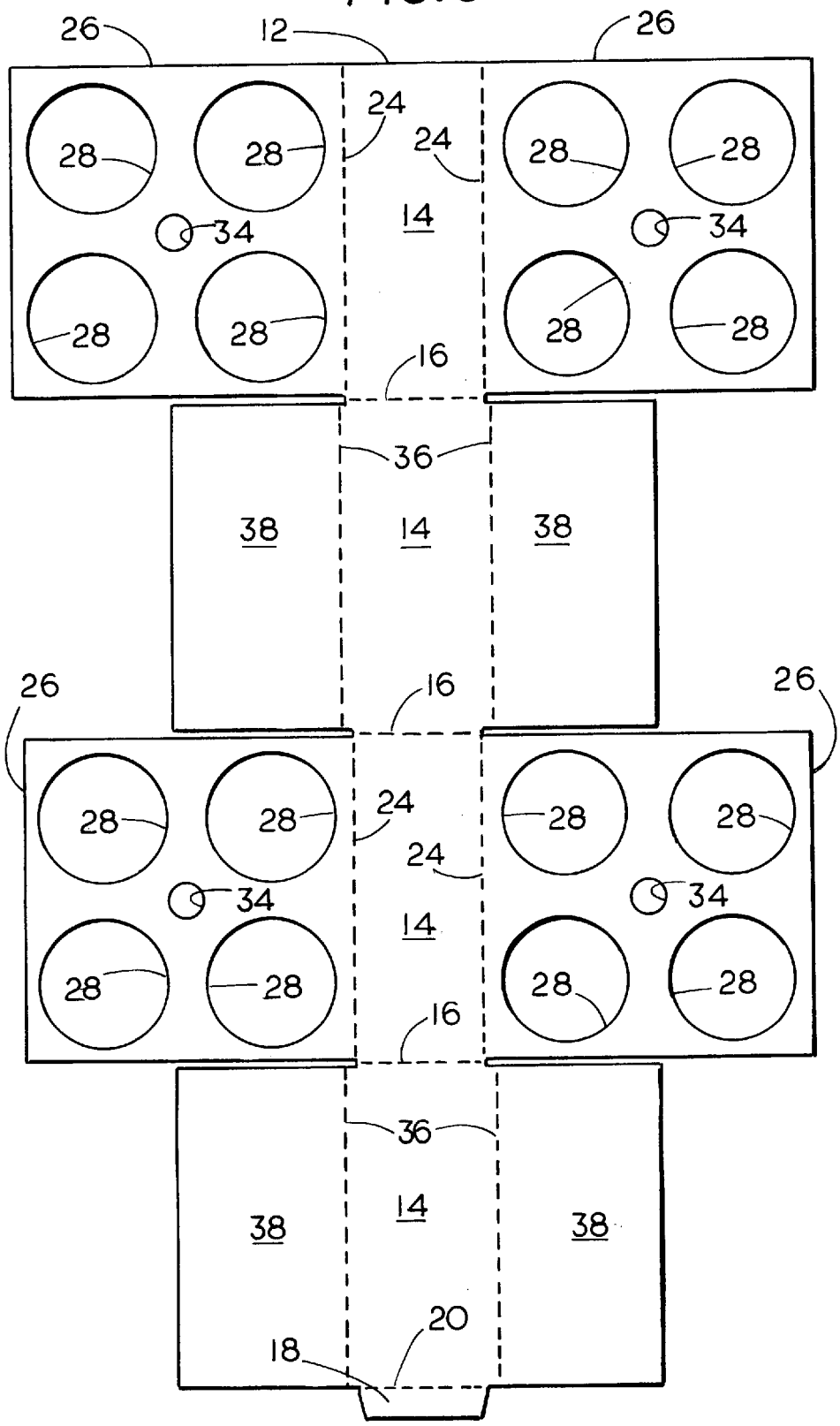
FIG. 6 is a plan view of the box blank used in making the box of FIG. 5.

The invention will be described by way of example in connection with shipping metal paint cans containing a hazardous substance, e.g., paint, varnish, solvent and the like even though it is well adapted for other applications. The box can be suited for shipping any number of articles, typically from one to six articles, e.g. one to four one-gallon cans, six one-quart cans or six one-pint cans, and can be made in various sizes. For example, a box for one article is illustrated in FIGS. 1–3B, a box for two articles is illustrated in FIG. 4, and a box for four articles is illustrated in FIGS. 5 and 6.

A box 10 in accordance with the invention is formed from a stamped blank 12 composed of corrugated paperboard. The blank 12 is provided with four upright, that is to say vertical, panels 14 connected by fold lines 16 and a connecting tab 18 which is connected to an adjacent panel 14 by means of a fold line 20. The connecting tab 18 is bonded, e.g. by means of adhesive such as hot-melt, resin emulsion or sodium silicate adhesive, at the box factory to provide a box-maker's connection 22 between two adjacent panels 14 at opposite ends of the blank 12. If desired, the tab 18 can be replaced with another suitable form of seal for certain applications, such as a strip of reinforced tape or the like. At this stage the ends of the box are not folded shut, and the blank 12 which is now in tubular form can be collapsed and shipped flat to a customer to be filled and sealed.

Extending horizontally from hinges defined by horizontal fold lines 24 at both the top and bottom of the box 10 are upper and lower pairs of full-overlap article-stabilizing flaps 26, each of which is provided with a punched opening 28 of just sufficient size to fit over the end of an article, e.g. a can of paint 30 which is being shipped in the box 10. As already mentioned, the box 10 can be sized to fit any number of articles. This is accomplished by providing different numbers of openings in the stabilizing flaps 26: one opening for a single article 30 in the case of FIGS. 1–3B, two openings 28 in the case of FIG. 4, and four openings 28 in the case of FIGS. 5–6. During use, the stabilizing flaps 26 are folded inwardly, i.e. centrally, to a horizontal position about the hinges defined by the fold lines 24 so that the punched openings 28 surround the ends of the article 30 that is being shipped. Thus, the flaps 26 are interlocked around the article 30 (FIG. 3B). It will be seen that the stabilizing flaps 26 are connected by means of the fold lines 24 to panels 14 on opposite sides of the box 10 with the stabilizing flaps 26 extending toward one another from opposing sides of the box 10. If desired, the fold lines 24, in addition to being compressed, can also be provided with serrations such as ⅜" serrations spaced ⅜" apart to make the flaps 26 easy to fold. Some or all of the stabilizing flaps 26 can be provided with punched finger openings or slots 32 (FIG. 4) or 34 (FIG. 6) to help a person lift or position the flaps 26 manually.

Connected to the remaining wall panels 14 by means of laterally spaced apart, horizontally disposed fold lines 36 are upper and lower pairs of end flaps 38. As best seen in FIG. 3B, the end flaps 38 are folded centrally on the fold lines 36 to a horizontal position overlapping the stabilizing flaps 26 at both the top and bottom of the box 10. Consequently, each pair of stabilizing flaps 26 is supported exteriorally by the laterally opposed end flaps 38 that contact and enclose both ends of the article 30 and the underlying stabilizing flaps 26 (FIG. 3B). The end flaps 38 thus function as half-flaps that are folded centrally so as to meet along a center line at each end of the box 10. FIG. 3B also shows how the fold lines 24 between the stabilizing flaps 26 and the side wall panels 14 form opposed anchoring points for the stabilizing flaps 26 which cooperate with the interlocking of the stabilizing flaps by the article 30 for strengthening and rigidifying the box 10 to provide improved protection for the article 30 packaged therein. Thus, the stabilizing flaps 26 both extend horizontally in a straight line toward the article 30 from the fold lines 24 at one edge thereof so as to act as a shock- and pressure-resisting brace between the side walls 14 and the article 30 being shipped. Contact between the stabilizing flaps 26 and the overlapped end flaps 38 supports the stabilizing flaps 26 exteriorally to further strengthen and immobilize the stabilizing flaps at each end of the box 10.

Many variations are possible. If the articles 30 being shipped are cans of paint, varnish or the like, the can lids can be held in place, if desired, by means of lid-retaining plastic rings such as polyethylene rings 30*a* (FIG. 5) sold under the trademark Armlok® by The Armstrong Container Corporation. The plastic rings 30*a* are pressed onto the tops of the cans 30 and each includes a lid-retaining lip located over the edge of the can lid for holding the lid in place on the can. The Armlok® rings 30*a* are especially useful in meeting the requirements of shipping hazardous material by air. However, the invention can be used with or without the retaining rings 30*a*. If the rings 30*a* are used, the punched openings 28 should be sized to accommodate them. To make the stabilizing flaps 26 easy to fold down, the punched openings 28 should have a small clearance, e.g. about 1/32" between the article 30 and the surrounding edge of the opening 28. However, in certain applications it may be desirable to provide a friction, i.e. interference, fit between the can and the edge of the opening 28.

Figure 1:
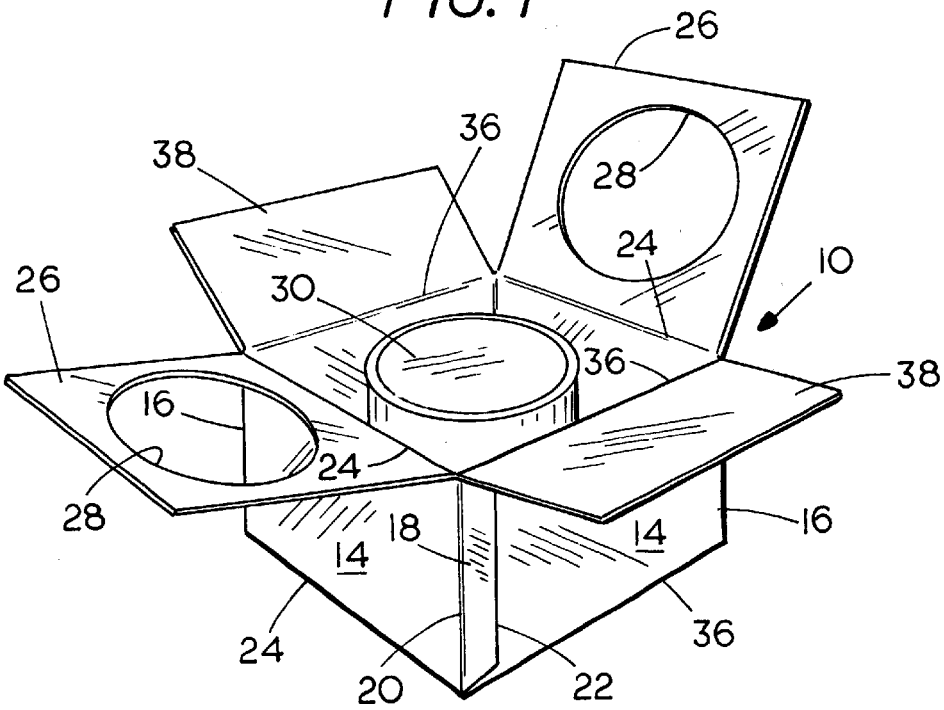
FIG. 1 is perspective view of a box in accordance with the invention for holding a single can.
Figure 2:
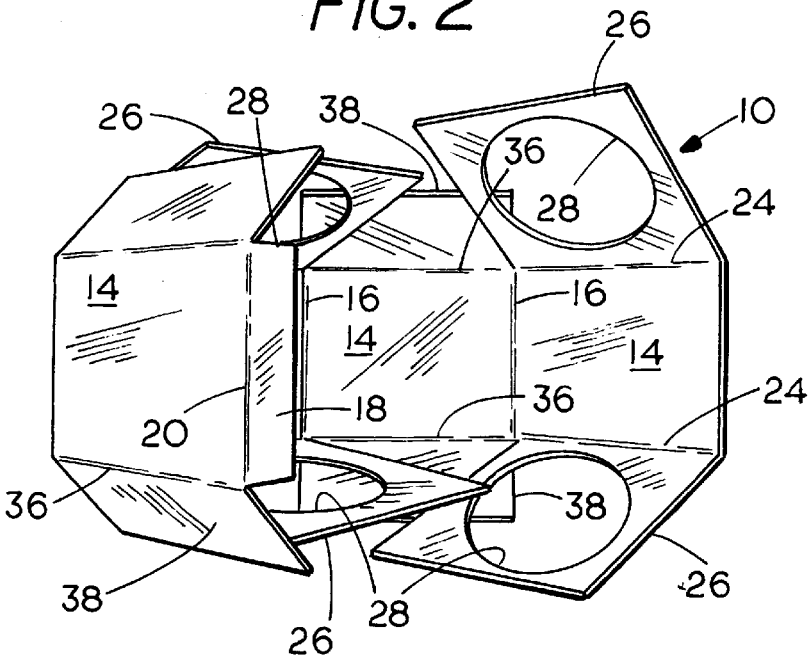
FIG. 2 is a perspective view of the box of FIG. 1 as it appears just prior to assembly by the box-maker.
Figure 3:
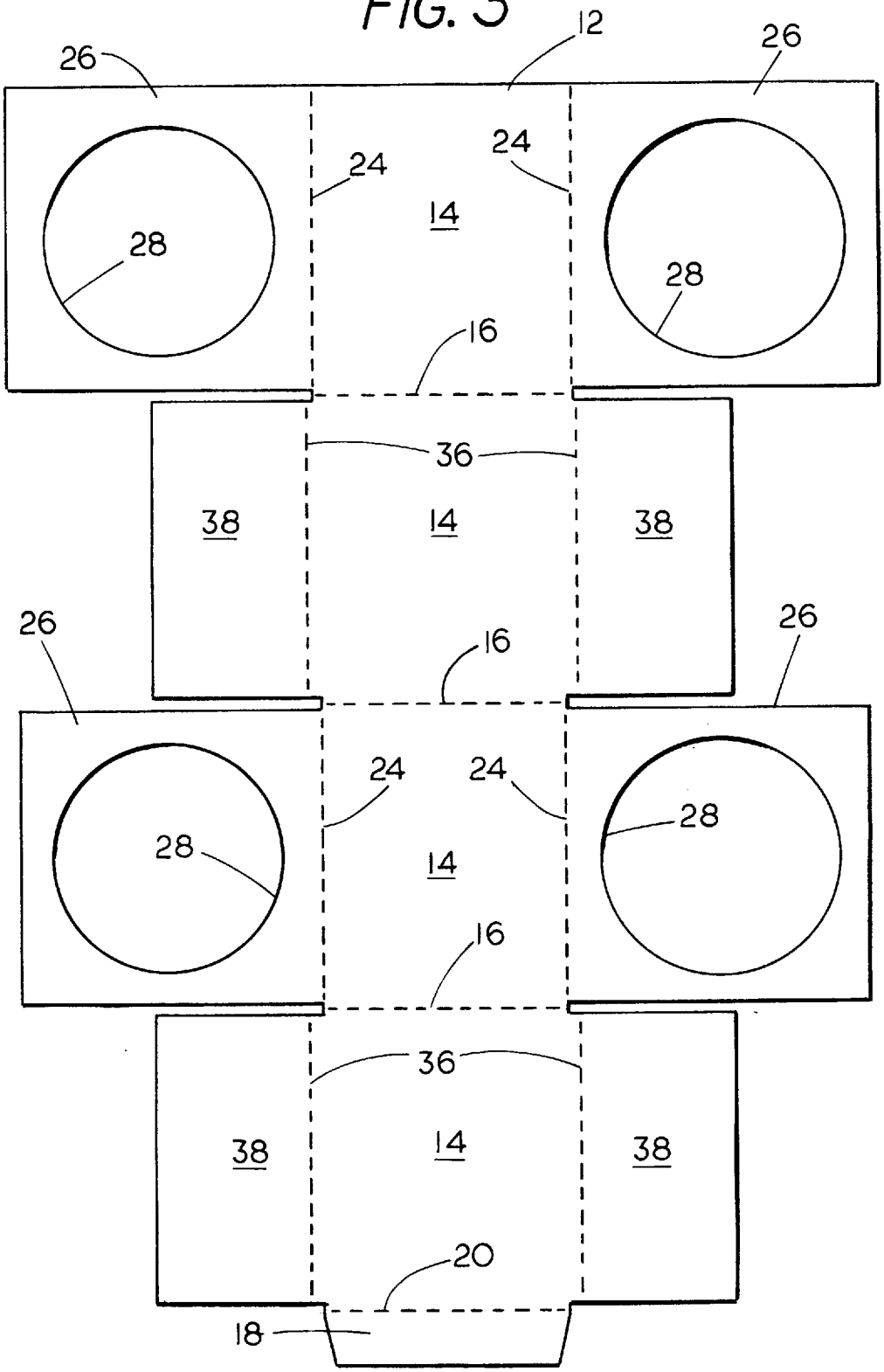
FIG. 3 is a plan view of the box blank used in FIGS. 1–2.
Figure 3A:
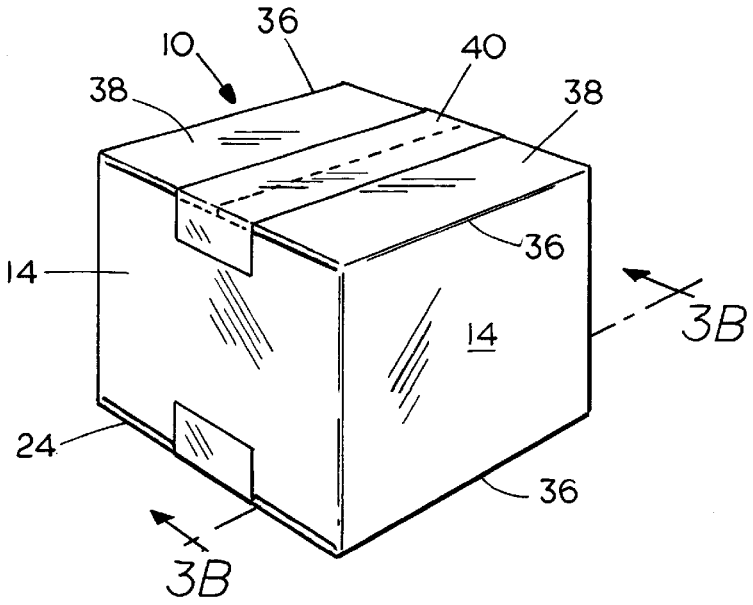
FIG. 3A is a perspective view of the box shown in FIGS. 1 and 2 after being filled and sealed.
Figure 3B:
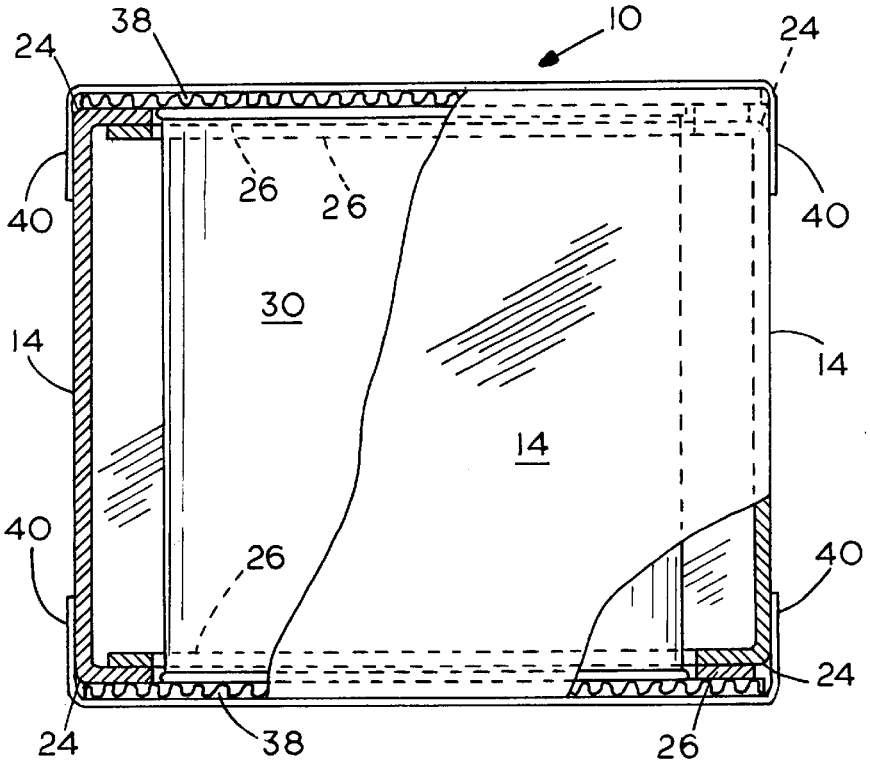
FIG. 3B is a side elevational view partly in section taken along lines 3B—3B of FIG. 3A but on a larger scale.

After the article 30 that is being shipped in the box 10 is enclosed and all of the flaps 26 and 38 are folded down to a horizontal position as shown in FIGS. 3A and 3B, the box 10 is taped shut by means of a suitable packaging tape such as a 3"-wide strip of pressure-sensitive tape 40 of any suitable known construction (FIGS. 3A and 3B) covering the joint between the flaps 38 at both the top and bottom of the box 10. However, it is contemplated within the scope of the invention to replace the pressure-sensitive tape 40 with a suitable adhesive such as a hot-melt adhesive applied between the flaps 38 and the underlying stabilizing flap 26 at both the top and bottom of the box 10.

It will be noticed that the box 10 of the present invention is easy to assemble since no extra parts or inserts are required, and that the stabilizing flaps 26 are entirely self-orienting and self-positioning by virtue of their hinged connected at 24 to the side walls 14, thus facilitating assembly. In addition, the invention provides a more secure and stable packaging of the article 30 since both stabilizing flaps 26 of each cooperating pair extend horizontally in a straight line toward the article 30 from the fold line 24 to provide a shock- and pressure-resisting brace between the side wall 14 and the article 30 that is being shipped. The physical contact between the pair of stabilizing flaps 26 and the end flaps 38 provides further support for the stabilizing flaps exteriorally to strengthen and immobilize the stabilizing flaps 26 at each end of the box 10. It can also be seen in FIG. 2 that, since the stabilizing flaps 26 engage the top and bottom ends of the article 30 rather than some point closer to the center of the article, the box 10 is better able to resist torque forces that occur when the box is dropped on its side. Thus, positioning the stabilizing flaps 26 at the top and bottom ends of the box 10 provide greater strength.

Besides providing better protection for the contents, the box 10 can be produced at a lower cost than boxes used heretofore since there is saving in paper. They also provide a saving in time and labor required for assembly. Thus, when the stabilizing flaps 26 are folded down they position themselves automatically around the ends of the article, e.g. paint can 30, by virtue of the hinge connection at 24 to the side walls 14. Consequently, the invention provides greater strength and product protection while reducing overall packaging costs.

Boxes in accordance with the invention can be constructed from any suitable corrugated paperboard. For example, in packaging four one-gallon cans, the box 10 can be formed from a sheet of 350 lb. test double-wall corrugated board. To ship one or two one-gallon cans of paint, the blank 12 can be composed of 275 lb. test double-wall or single-wall corrugated board. However, the invention is not limited to a particular form of corrugated paperboard; other materials and even plastic sheet material can be used for certain applications.

The invention provides outstanding performance and exceeds the shock, vibration and drop test requirements of the International Safe Transit Association tests, as well as the United Nations Package Performance Test.

Many variations of the present invention within the scope of the appended claims will be apparent to those skilled in the art once the principles described herein are understood.

What is claimed is:

1. A single-piece corrugated box suited for shipping one or more articles comprising, four upright side wall panels connected together by vertical fold lines, upper and lower pairs of full-overlap article-stabilizing flaps that extend centrally from horizontal fold lines that connect said flaps to opposing upright side walls, said stabilizing flaps having punched openings therein that are positioned in vertical alignment with each other so that one pair of stabilizing flaps surrounds the upper end of the article and the other pair of stabilizing flaps surrounds the lower end of the article, each pair of stabilizing flaps is supported exteriorally by at least one end flap that is folded centrally so as to enclose the ends of the article and the underlying stabilizing flaps, the horizontal fold lines between the stabilizing flaps and opposed side wall panels form anchoring points on opposite sides of the package for the stabilizing flaps that cooperate with an interlocking of the stabilizing flaps around the article being shipped to strengthen and rigidify the box to thereby enhance protection of the article packaged therein, the stabilizing flaps are devoid of fold lines and extend horizontally in a straight line toward the article from said horizontal fold lines to provide a shock- and pressure-resisting brace between the side wall connected thereto and the article being shipped, and contact between the stabilizing flaps and the overlapped end flaps supports the stabilizing flaps exteriorally to strengthen and immobilize the stabilizing flaps at both the top end and the bottom end of the box.

2. The box of claim 1 wherein the box is formed from single-wall or double-wall corrugated paperboard.

3. The box of claim 1 wherein the end flap comprises a pair of cooperating centrally folded half-flaps secured in overlapping position in contact with an underlying stabilizing flap by a strip of tape that is wrapped around the box.

4. The box of claim 1 wherein each of the stabilizing flaps is provided with a single opening and each of the openings is aligned for enclosing a single article within the box.

5. The box of claim 1 wherein each of the stabilizing flaps is provided with multiple openings and each of the openings is aligned with a corresponding opening in an adjacent flap for packaging multiple articles in said box and the top and bottom ends of each article extending through openings provided in product-stabilizing flaps at the top and bottom of the box and the ends of the article abut the end flaps.

6. The box of claim 1 wherein the article is a metal can containing paint, varnish, solvent or other hazardous substance, and the punched opening in each stabilizing flap comprises a circular opening sized to fit the can.

7. The corrugated box of claim 1 for use in combination with said article wherein, said article comprises a can, the punched openings in the stabilizing flaps are of just sufficient size to fit around each end of the can so as to surround the ends of the can for bracing the can laterally, and the can has top and bottom ends that abut inside surfaces of said end flaps at each end of the box.

* * * * *